US011712133B2

(12) United States Patent
Mantenuto

(10) Patent No.: US 11,712,133 B2
(45) Date of Patent: Aug. 1, 2023

(54) NICHE ASSEMBLY SYSTEM AND METHOD

(71) Applicant: 2721111 Ontario Inc., Maple (CA)

(72) Inventor: Paolo Mantenuto, Concord (CA)

(73) Assignee: 2721111 Ontario Inc., Maple (CA)

( * ) Notice: Subject to any disclaimer, the term of this patent is extended or adjusted under 35 U.S.C. 154(b) by 294 days.

(21) Appl. No.: 17/062,056

(22) Filed: Oct. 2, 2020

(65) Prior Publication Data

US 2021/0100404 A1 Apr. 8, 2021

Related U.S. Application Data

(60) Provisional application No. 62/910,761, filed on Oct. 4, 2019.

(51) Int. Cl.

| | |
|---|---|
| ***A47K 3/28*** | (2006.01) |
| ***E04C 2/04*** | (2006.01) |
| ***A47K 3/30*** | (2006.01) |

(52) U.S. Cl.

CPC ..... *A47K 3/283* (2013.01); *A47K 3/281* (2013.01); *A47K 3/30* (2013.01); *E04C 2/04* (2013.01); *A47K 2003/307* (2013.01)

(58) Field of Classification Search

CPC ..... A47K 3/28; A47K 3/281; A47K 3/283; A47K 3/30; A47K 2003/307

See application file for complete search history.

(56) References Cited

U.S. PATENT DOCUMENTS

| | | | | |
|---|---|---|---|---|
| 1,723,410 A * | 8/1929 | Bostick | A47K 3/283 4/596 |
| 2,394,594 A * | 2/1946 | Cohn | A47K 3/283 52/274 |
| 2005/0172395 A1* | 8/2005 | Helmetsie | A47K 3/282 4/612 |
| 2016/0206156 A1* | 7/2016 | Smith | A47K 3/40 |

FOREIGN PATENT DOCUMENTS

| | | | | |
|---|---|---|---|---|
| DE | 102016101095 | * | 7/2017 | A47K 3/30 |

* cited by examiner

*Primary Examiner* — J C Jacyna
(74) *Attorney, Agent, or Firm* — DLA Piper LLP (US)

(57) ABSTRACT

A stone niche assembly system and method is disclosed, which includes collapsed and adjustable modular stone tile components with stabilizing grooves to be assembled into a stone niche for installation in the wall of a shower enclosure, for example.

13 Claims, 2 Drawing Sheets

NICHE ASSEMBLY SYSTEM AND METHOD

TECHNICAL FIELD

The present disclosure relates generally to a niches in stone or stone-like walls for shower and bath enclosures. More specifically, the present disclosure relates to an adjustable and collapsible niche assembly system for incorporation into the construction of a shower or bath enclosure, or similar.

BACKGROUND

A shower niche, as this term is used in the art, is a cavity that is built into a wall of a shower or bath enclosure for an aesthetic or practical purpose, such as to provide shelving for items typically kept in showers (e.g. soap and shampoo). The construction, assembly, and cladding of a shower niche is typically a complicated and time consuming endeavor for a contractor or homeowner.

A recent development is the use of pre-fabricated waterproofed board niches offered by drywall suppliers and others for integration in to a completed and waterproofed shower or bath enclosure rough-in. Although such pre-fabricated assemblies may simplify the installation process, such configurations are not without drawbacks. One such drawback is the difficult and time consuming nature of cladding a niche, whether pre-fabricated or fabricated in situ.

One approach to clad a pre-fabricated board niche, or any niche fashioned in situ, is to use the same modular tile already used in the completed waterproofed shower system. As the tile body is often a different colour than the tile face, several methods are used to prevent tile body exposure, to maintain the niche's aesthetically pleasing appearance. One such method is to cut the abutting tiles at 45 degree angles on both planes of intersection, known as 'mitred' cuts. Another method is to use metal or plastic edge trims designed to conceal the otherwise exposed tile edges. A third method is to use four custom cut and finished ledges, leaving the back wall plate cladded in the same tile as the rest of the shower.

Another option to clad a niche is to use a pre-glued pre-fabricated niche, which may come in a variety of materials including stainless steel, cement pre-cast, and stone laminate. One drawback to using a pre-glued pre-fabricated niche is that it cannot later be modified. A second drawback is that pre-glued pre-fabricated niches are often bulky, and are easily damaged during transportation, storage, and installation. If damaged, the entire niche would typically need to be discarded. The installation process is time consuming, labour intensive, and often costly as a result.

It is often desirable to clad a shower niche entirely in stone, and often to match the stone to other shower tiles or accessories. Stone niches are typically only found in more expensive homes as they are custom cut and assembled by stone shops on an order-to-order basis. The niche pieces are glued together using epoxy resin with a butt joint and the lower ledge is often inclined one to two percent, to promote water drainage.

There is a need for an easily assembled stone niche assembly system that avoids the drawbacks of using pre-fabricated board niches requiring time-consuming cladding, or pre-glued pre-fabricated niches made of other materials that cannot later be modified and are easily damaged during transportation and storage.

SUMMARY

Disclosed herein is a modular stone niche assembly comprising a back wall and four side walls that combine to form a niche, the back wall having a predetermined thickness, each side wall comprising an interior surface opposite an exterior surface, the interior surface substantially exposed to the interior of the niche, a front edge opposite a back edge, a first end and a second end, a groove formed in the interior surface proximate to the back edge and extending transversely along the length of the side wall, the groove having a depth and a thickness, the thickness of the groove being larger than the predetermined thickness of the back wall and configured to receive the back wall, a ridge between the groove and the back edge, and having a predetermined height based on the stone of the side wall and configured to support the back wall during installation of the niche, wherein the groove is preformed in each side wall ex-situ prior to assembly and installation of the niche.

Further disclosed herein is a modular stone niche assembly wherein the side walls are formed from one of natural or synthetic stone.

Further disclosed herein is a modular stone niche assembly wherein at least one of the first or second ends being adapted for cutting to remove a predetermined length of stone.

Further disclosed herein is a modular stone niche assembly wherein the depth of the groove is predetermined based on and corresponding to the predetermined height of the ridge.

Further disclosed herein is a modular stone niche assembly wherein the depth of the groove is at least 5 mm.

Further disclosed herein is a modular stone niche assembly wherein the groove is preformed prior to packaging of the modular stone niche assembly.

Further disclosed herein is a modular stone niche assembly wherein for at least two of the side walls, at least one of the first end or second end is precut to greater than 90 degrees relative to the back edge to assist with drainage from the niche, once installed.

Further disclosed herein is a method for constructing a stone niche, comprising the use of the modular stone niche assembly above, comprising the steps of: 1) placing an adhesive into the groove of each of the side walls, 2) placing the back wall into the groove of each of the side walls to form the niche, and 3) installing the niche into an enclosure of a predetermined height and width to receive the niche.

Further disclosed herein is a method wherein prior to step (1), at least two of the side walls are cut in-situ to remove the predetermined length of stone.

Further disclosed herein is a method wherein the predetermined length of stone is removed to reduce the height of the niche once assembled.

Further disclosed herein is a method wherein the predetermined length of stone is removed to reduce the width of the niche once assembled.

Further disclosed herein is a method wherein the predetermined length of stone is removed to reduce the width and the height of the niche once assembled.

Further disclosed herein is a method wherein step (3) occurs before the adhesive has set.

Further disclosed herein is a prepackaged kit comprising the modular stone niche assembly of any of the embodiments described above.

BRIEF DESCRIPTION OF THE DRAWINGS

In the following detailed description, reference is made to the accompanying drawings that form a part hereof, and in which are shown, by way of illustration, in specific exemplary embodiments which may be practiced. These exemplary embodiments are described sufficient detail to enable those skilled in the art to understand the scope of the disclosure and claims. Other embodiments may be utilized, and structural, logical, and electrical changes may be made.

DETAILED DESCRIPTION

Figure 1:
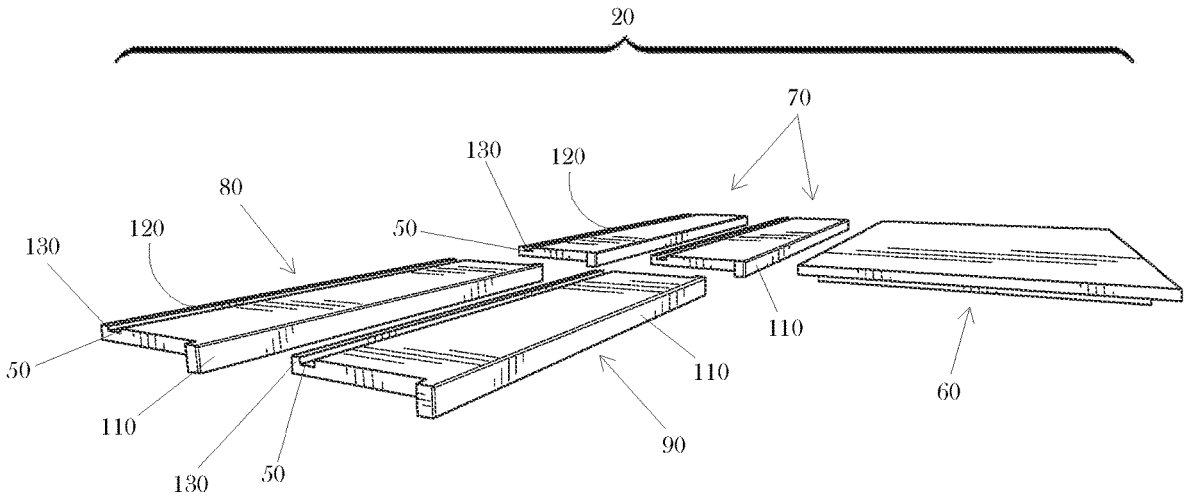
FIG. 1. is an exemplary embodiment of a perspective view of the collapsed modular stone tile components of the preferred embodiment.

One embodiment, the stone niche 10 assembly system comprises the modular stone tile components 20 shown in FIG. 1. This embodiment comprises modular stone tile components 20 incorporated in to the construction of the wall 30 of a shower enclosure. It is appreciated, however, that other embodiments may be implemented in natural or synthetic stone sinks, tubs, hoods, backsplashes, furniture niches (such as medicine cabinets, bar niches or the like), or similar. Modular stone tile components 20 are provided for stone niche 10 assembly. In this embodiment, the stone niche 10 assembly system comprises collapsed and adjustable modular stone tile components 20 with stabilizing grooves 50 for ease of assembly and increased adhesive surface area.

The modular stone tile components 20 of the preferred embodiment include a back wall 60, two side walls 70, a top wall 80 and a bottom wall 90 (collectively, the end walls 100). While the preferred embodiment is described for use with stone, the person skilled in the art would appreciate that any natural stone, synthetic stone (such as Corian™, engineered quartz, cultured marble, cultured granite, cultured onyx, or similar), ceramic/porcelain, or other similar material may be used for the niche 10.

In this embodiment, the length of the side 70 and end walls 100 is predetermined to cooperate to fit the largest niche 10 desired for this embodiment. To accommodate for the largest niche 10, the components 20 can be assembled as is, but may also be cut down to accommodate for smaller niches 10, as desired. In this embodiment, the side walls 70 correspondence to the length of the long edges of the back wall 60, while the end walls 100 correspond to the length of the shorter edges of the back wall 60.

In this embodiment, each of the side 70 and end walls 100 also has a width that is perpendicular to the length when each piece is laid flat. In this embodiment, the width of the side 70 and end walls 100 is equal, and predetermined based on the desired depth of the stone niche 10. It will be appreciated by the person skilled in the art that one or more of the pieces could have a longer width than the others, for example if it is desired that the bottom wall 90 of the niche 10 protrudes as a ledge of the remaining wall 30 of the shower or bath enclosure 40.

In this embodiment, each of the side 70 and end walls 100 has a front edge 110 facing the direction of the shower or bath 40, and a back edge 120 that will be facing away from the shower or bath 40. Proximate to the back edge 120 of the side 70 and end walls 100 is a groove 50 configured to correspond and receive the back wall 60 when the stone niche system 10 is assembled. The groove 50 runs transversely along the length of the side 70 or end wall 100 and is cut into the surface of the wall 70 or 100 to a depth of 5 to 15 mm. With thicker walls 70 or 100, the depth of the groove 50 may be deeper. It will be appreciated by those skilled in the art that the groove 50 may also be shallower where the material is more resilient, or as desired for ease of manufacture and assembly. In this embodiment, the groove 50 is formed in the stone prior to packaging of the components 20 using a milling machine for stone. It would be appreciated by those in the art that the formation of a groove 50 with a consistent depth and dimensions requires specialized equipment and is unlikely to be undertaken by an installer of a stone niche on site. In fact, an installer would typically avoid such a step due to the high likelihood of damaging the stone, an expensive material to work with, which would typically mean the entire piece of stone would be discarded (or possibly repurposed).

While the width of the groove 50 may vary, it is preferred that the width corresponds to a distance that comfortably receive the edge of the back wall 60 without the need to pressure the edge into the groove 50, to ensure ease of assembly and prevent breakage of the stone. In some embodiments, the width may exceed the dimensions of the back wall 60 edge, for example to accommodate for additional adherent, but in the preferred embodiment the back wall 60 is comfortably received by the groove 50 with little extra space.

The depth of the groove 50 is selected based on the material used for the walls 70 and 100, including the back wall 60. The depth of the groove 50 will need to be selected to avoid compromising the integrity of the wall 70 or 100 piece, such that more brittle materials may require a shallower groove 50 or a correspondingly thicker wall 70 or 100 piece to accommodate a groove 50 that is thick enough to support the back wall 60 once assembled. A sufficient thickness of material must remain to minimize the likelihood of breakage during assembly and to support the weight of the back wall 60 during installation.

The thickness of the ridge 130 that is formed between the groove 50 and edge of the side 70 or end walls 100 may also vary depending on the nature (including the brittleness and load bearing capacity) of the material. Ultimately, the thickness of this ridge 130 may be used to support the back wall 60 as the assembled niche 10 is lifted and placed into the desired location in the shower or bath enclosure 40. The person skilled in the art would appreciate that the size and configuration of this ridge 130 may vary, and may be omitted on the side walls 70 provided adequate ridges 130 are included on the end walls 100, and vice versa.

In an exemplary method of forming a stone niche 10 from the modular stone tile components 20 of the stone niche assembly system, the end walls 100 are first adjusted to the width of the interior niche cavity 140. The side walls 70 may be trimmed using a wet saw or angle grinder, or similar equipment known in the art, to adjust the height and width of the stone niche cavity 140. If only adjusting the height of the niche cavity 140, the side walls 70 are trimmed while the end walls 100 are not trimmed. The back wall 60 is trimmed by the same amount as the end walls 100 when the width of the stone niche cavity 140 is adjusted, and by the same amount as the side walls 70 when the height of the stone niche cavity 140 is adjusted. In this embodiment, trimming of the various components 20 may be done on site based on the specific measurements of the opening in the drywall to receive the niche 10. The need to have pieces carefully cut off site may therefore be avoided, and any corresponding delay caused by incorrect measurements or replacing components damaged during transport may be avoided.

Figure 2:
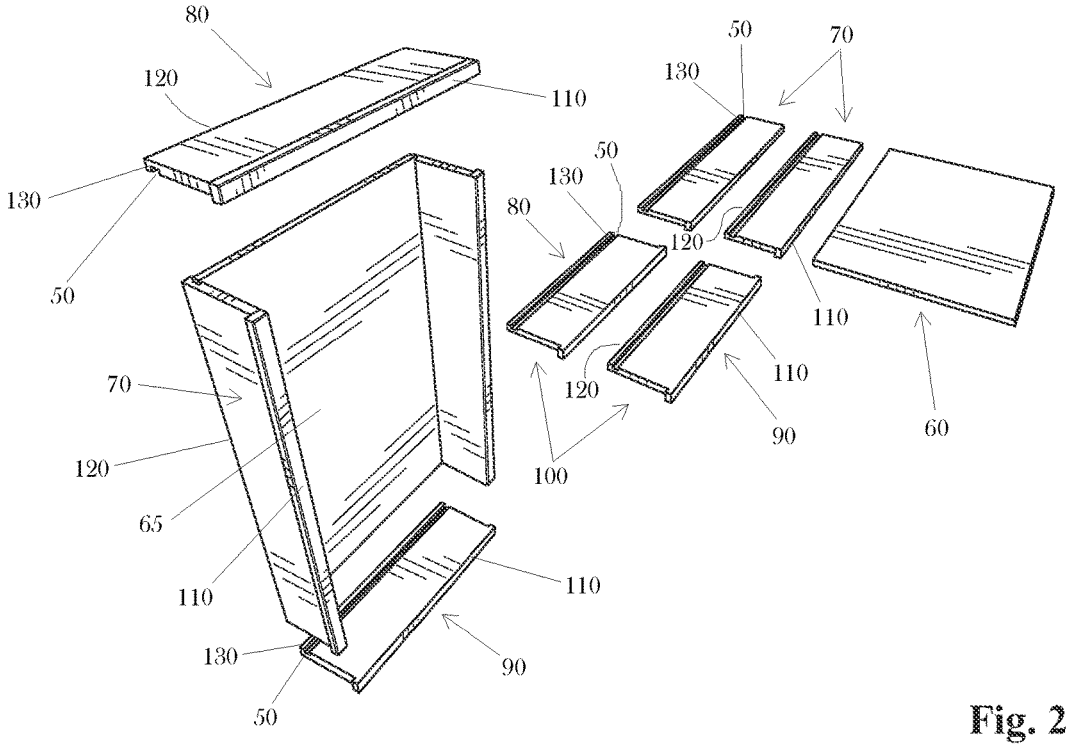
FIG. 2. is a perspective view of an exemplary embodiment the stone niche mid-assembly with the perimeter stone tile components have stabilizing grooves, while the back wall of the niche cavity does not have stabilizing grooves.
Figure 3:
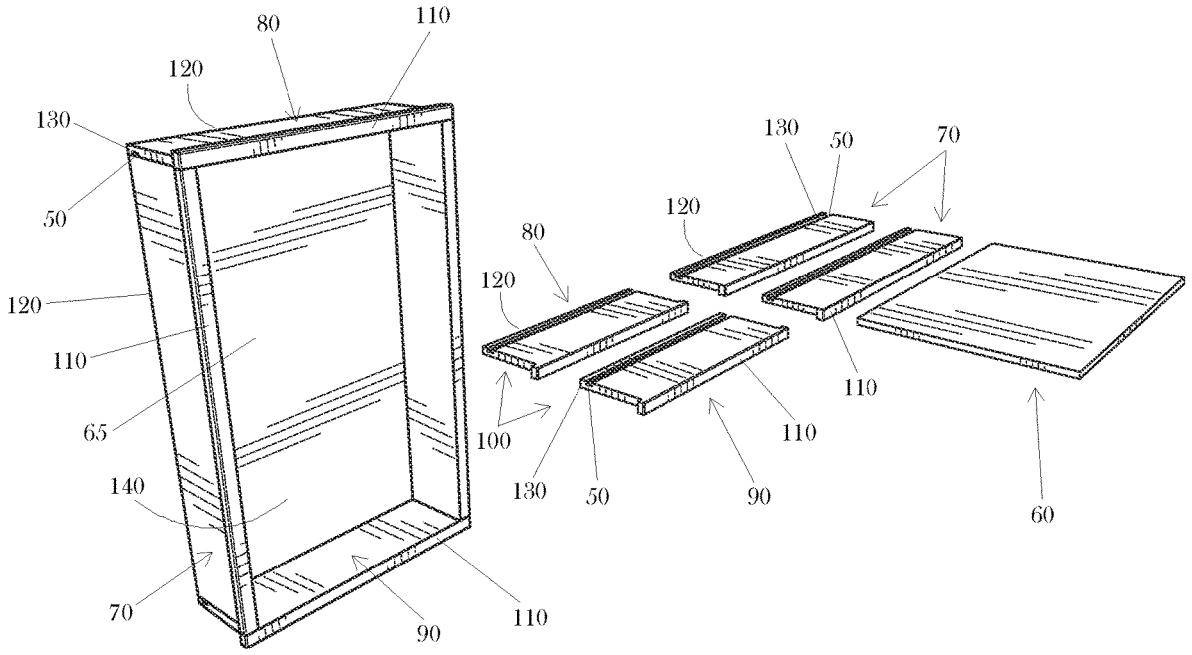
FIG. 3. is a perspective view of an exemplary embodiment the assembled stone niche.

Once the modular stone tile components 20 have been adjusted to the desired size, the stabilizing grooves 50 are filled with adhesive and the stone tile edges of the back wall 60 component are slid in to the stabilizing grooves 50 on the perimeter components 20, as shown in FIG. 2. The stabilizing grooves 50 allow the stone niche assembly 10 to be structurally self-supportive in a short period of time, in some instances immediately, even before the adhesive is set, as shown in FIG. 3. The support provided by the stabilizing grooves 50, and in particular the corresponding ridges 130 toward the back edge 120 of each wall 70 and 100, allow for less adhesive and also an adhesive with a lower adhesion strength, which may be easier for the installer to work with.

Once assembled, the stone niche 10 may be installed in to the wall 30 of the shower or bath enclosure 40. With this embodiment, the installation time and labour may be significantly reduced compared to the conventional approach to stone niche construction and installation. This is particularly so if the modular stone tile components 20 do not requiring trimming, such that the stone niche assembly process may take only a few minutes, compared to hours.

In another embodiment, the side 270 and end walls 200 of the niche 210 may be made of natural or synthetic stone, while the back wall 260 is made from a different or less costly material, such as porcelain or glass tiles, or similar. In this embodiment, once the niche 210 is assembled, and either prior to installation or after installation, decorative tiles 245 are installed on the front face 265 of the back wall (i.e. the face of the back wall 260 exposed to the shower or bath enclosure 40). For convenience, this may be done with the niche assembly 210 laying flat on the ground for installation once the decorative tile 245 have been set in grout, but the person skilled in the art would also appreciate that the decorative tiles 245 may be installed in the conventional manner once the niche assembly 210 has been installed. With the dimensions of the niche cavity 240 having been predetermined, in this embodiment any tiles 245 that required cutting can be pre-cut off site and/or in advance of installation to improve efficiency.

In a further embodiment, the stone niche assembly system comprises collapsed and adjustable modular stone tile components 20 with stabilizing grooves 50 and the four perimeter components 70 and 100 are pre-inclined one to two degrees to assist with drainage.

In a further embodiment, the stone niche assembly system comprises collapsed and adjustable modular stone tile components 20 with stabilizing grooves 50, and the four perimeter components 70 and 100 have a small lip and are pre-inclined one to two degrees.

The exemplary method of forming a stone niche 10 from the modular stone tile components 20 of the stone niche assembly system includes adjusting the modular stone tile components 20 to a desired size; filling the stabilizing grooves 50 with adhesive; sliding the stone tile edges in to the stabilizing grooves 50 to form the stone niche cavity 140; waiting for the adhesive to set; and installing the stone niche cavity 140 into the shower wall 30.

In another embodiment of the preferred method, the stone niche cavity 140 is installed in to the shower wall 30 prior to the adhesive setting; minimally adjusted after being installed in to the shower wall 30; and left to dry after installation.

In another embodiment of the preferred method, the reverse, rough side of the back wall component 60 is kept exposed during the stone niche 10 assembly, allowing for later cladding of the back wall component 60 using decorative tiles 45, or similar.

While the above description contains many specifics, these should not be construed as limitations on the scope of the claims, but rather as exemplifications of one or another preferred embodiment thereof. The scope of the invention should be determined by the scope of the appended claims, and not just by the embodiments.

It should be understood that steps or the order of the steps described herein may be altered, modified, and/or augmented and still achieve the desired outcome. Further, the various features and adaptations described in respect of one example or embodiment in this disclosure can be used with other examples or embodiments described herein, as would be understood by the person skilled in the art.

A portion of the disclosure of this patent document may contain material that is or may be subject to one or more of copyright, design, or trade dress protection, whether registered or unregistered. The rights holder has no objection to the reproduction of any such material as portrayed herein through facsimile reproduction of this disclosure as it appears in the Patent and Trademark Office records, but otherwise reserves all rights whatsoever.

As used herein, the terms "comprises", "comprising", "includes", "including", "has", "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

Also, use of the "a" or "an" are employed to describe elements and components of the disclosed apparatus. This is done merely for convenience and to give a general sense of the disclosed apparatus. This description should be read to include one or at least one and the singular also includes the plural unless it is obvious that it is meant otherwise.

Throughout the specification, terms such as "may" and "can" are used interchangeably. Use of any particular term should not be construed as limiting the scope or requiring experimentation to implement the claimed subject matter or embodiments described herein.

Further, while the specification may have articulated specific technical problems that are addressed by the disclosure and claims, the disclosure is not intended to be limiting in this regard; the person of ordinary skill in the art will readily recognize other technical problems addressed by the disclosure and claims. Unless otherwise defined, all technical and scientific terms used herein have the same meaning as commonly understood by one of ordinary skill in the art to which this disclosure belongs. Although methods and materials similar or equivalent to those described herein can be used in the practice or testing of the presently disclosed embodiments, suitable methods and materials are described below. In case of conflict, the present specification, including definitions, will control. In addition, the materials, methods, and examples are illustrative only and not intended to be limiting.

What is claimed is:

1. A modular stone niche assembly comprising:

a back wall and four side walls that combine to form a niche, the back wall having a predetermined thickness, each side wall comprising:

an interior surface opposite an exterior surface, the interior surface substantially exposed to the interior of the niche, a front edge opposite a back edge, a first end and a second end, a groove formed in the interior surface proximate to the back edge and extending transversely along the length of the side wall, the groove having a depth and a thickness, the thickness of the groove being larger than the predetermined thickness of the back wall and configured to receive the back wall, a ridge between the groove and the back edge, and having a predetermined height based on the stone of the side wall and configured to support the back wall during installation of the niche, wherein the groove is preformed in each side wall ex-situ prior to assembly and installation of the niche.

2. The modular stone niche assembly of claim 1, wherein the side walls are formed from one of natural or synthetic stone.

3. The modular stone niche assembly of claim 1, wherein at least one of the first or second ends being adapted for cutting to remove a predetermined length of stone.

4. The modular stone niche assembly of claim 1, wherein the depth of the groove is predetermined based on and corresponding to the predetermined height of the ridge.

5. The modular stone niche assembly of claim 1, wherein the depth of the groove is at least 5 mm.

6. The modular stone niche assembly of claim 1, wherein the groove is preformed prior to packaging of the modular stone niche assembly.

7. The modular stone niche assembly of claim 1, wherein for at least two of the side walls, at least one of the first end or second end is precut to greater than 90 degrees relative to the back edge to assist with drainage from the niche, once installed.

8. A method for constructing a stone niche, comprising the use of the modular stone niche assembly of claim 1, comprising the steps of:

1) placing an adhesive into the groove of each of the side walls, 2) placing the back wall into the groove of each of the side walls to form the niche, and 3) installing the niche into an enclosure of a predetermined height and width to receive the niche.

9. The method of claim 8, wherein prior to step (1), at least two of the side walls are cut in-situ to remove the predetermined length of stone.

10. The method of claim 9, wherein the predetermined length of stone is removed to reduce the height of the niche once assembled.

11. The method of claim 9, wherein the predetermined length of stone is removed to reduce the width of the niche once assembled.

12. The method of claim 9, wherein the predetermined length of stone is removed to reduce the width and the height of the niche once assembled.

13. The method of any claim 9, wherein step (3) occurs before the adhesive has set.

* * * * *